United States Patent [19]

Kuhl

[11] 4,217,466

[45] Aug. 12, 1980

[54] COMPOSITE INSULATORS

[75] Inventor: Martin Kuhl, Selb, Fed. Rep. of Germany

[73] Assignee: Rosenthal Technik AG, Fed. Rep. of Germany

[21] Appl. No.: 848,297

[22] Filed: Nov. 3, 1977

[30] Foreign Application Priority Data

Nov. 3, 1976 [DE] Fed. Rep. of Germany ..... 2650363

[51] Int. Cl.[2] ..... H01B 17/02

[52] U.S. Cl. ..... 174/209; 174/179

[58] Field of Search ..... 174/DIG. 1, 137 B, 177, 174/178, 179, 186, 209, 211; 29/631

[56] References Cited

U.S. PATENT DOCUMENTS

| | | | |
|---|---|---|---|
| 3,898,372 | 8/1975 | Kalb | 174/179 |
| 4,001,128 | 1/1977 | Penneck | 174/137 B |

FOREIGN PATENT DOCUMENTS

| | | | |
|---|---|---|---|
| 1081223 | 5/1960 | Fed. Rep. of Germany | 174/DIG. 1 |
| 1921299 | 11/1970 | Fed. Rep. of Germany | 174/179 |
| 2425076 | 11/1975 | Fed. Rep. of Germany | 174/179 |
| 1116197 | 6/1968 | United Kingdom | 174/179 |
| 1292276 | 10/1972 | United Kingdom | 174/179 |

*Primary Examiner*—Laramie E. Askin

[57] ABSTRACT

An elongated electrical insulator has a supporting rod and barriers or screens spaced along the rod; an intermediate layer of material between the rod and the barriers or screens serves to exclude atmospheric moisture and other materials enhancing the electrical insulating characteristics of the insulator. The rod comprises a non-saponifiable resin reinforced with fiber glass of low alkali content. The barriers or screens comprise a non-saponifiable moisture-repellent polymer containing a filler. The intermediate layer comprises a moisture-repellent non-saponifiable polymer.

19 Claims, 3 Drawing Figures

COMPOSITE INSULATORS

BACKGROUND OF THE INVENTION

This invention relates to composite insulators, especially for high-tension open-air use.

Two different constructional forms of insulator are already known. In one case the insulators are of the same material throughout and in the other case they have an internal part, which takes up the mechanical forces: this is fitted with external barriers or screens. The materials of the two elements are different and are so chosen as to suit the different functions of the two elements. In the latter case, the barriers or screens (which are insulating) when secured on the internal part, e.g. a synthetic plastic rod, serve to increase the creepage distance. This latter type of construction is known by the term "composite insulator".

High-tension composite insulators of synthetic plastic materials must conform to specific electrical requirements. The carrier rod must be electrically insulating in its axial direction and the insulating barriers or screens must be fitted in such a way that no electrical conduction can occur at the seam between the barriers or screens and the rod. Moreover, the barriers or screens must be so dimensioned that their thickness is sufficient to prevent their electrical resistance being overcome. Furthermore, the material of the barriers or screens must have not only good weather stability, ultra-violet stability and ozone stability but also an outstanding electrical tracking resistance.

For high-tension composite insulators, widely varying materials are known for the inner core and for the insulating barriers or screens fitted on it; by way of example, the barriers or screens may be produced from porcelain, glass, clay, stone material or even molded plastic material and hard paper may be used for the core. The insulators have been so designed that seals are provided between the barriers or screens themselves and also between the barriers or screens situated at the ends and any fittings, usually of metal, for attaching the insulator to a support and for attaching a conductor to the insulator. The seals are intended to prevent the penetration of air or water into the joints between the barriers or screens and the rod. Also, the space between the individual barriers or screens and the core has been filled with a compound or similar composition of good insulating properties. These measures have been considered necessary in order effectively to prevent the penetration of water into the joints between the barriers or screens and the rod.

Further known features concerning the assembly and selection of the insulating material for high-tension composite insulators are almost all concerned with the question of sealing the rod against environmental influences by means of the jacket surrounding it.

German accepted patent specification No. 12 96 341 describes the formation of the barrier or screen materials from a mixture of a cycloaliphatic epoxy resin or an unsaturated polyester resin with a suitable hardener and with aluminum oxide trihydrate as filler. A molding resin composition is selected as the core and this preferably consists of a mixture of an epoxy resin based bisphenol A with a suitable hardener and a filler, for example, quartz flour. The core is not reinforced with fibres and has no great mechanical strength. Moreover, there is a serious danger of inadequate insulation in the joint between the barrier or screen material and the subsequently cast-in core because, as the core is the last unit of the component and passes from the liquid into the solid phase, it tends to shrink away from the already solid material, centrally towards its axis.

In U.S. Pat. No. 3,898,372 a composite insulator is described in which prefabricated insulating barriers or screens having a bore diameter smaller than the diameter of the rod are pushed onto a resin-bonded glass-fibre rod, the joint between the screens and the glass-fibre rod being filled with an insulating grease. The sealing of the joints to the external atmosphere is achieved in that the insulating barriers or screens are compressed onto the rod with an axial pressure, so that seals result between the joints of the individual barriers or screens and between the last barriers or screens and the metallic suspension fittings on the ends of the insulator. The barriers or screens themselves comprise an ethylene-propylene-polymer rubber which is filled with inorganic fillers and is stable to creepage current and weather. Polyester resins, bisphenol epoxy resins and cycloaliphatic epoxy resins are specified as materials for the glass-fibre rod.

The basis of the type of insulator just described is that the barrier or screen material must be weather-resistant and resistant to creepage current. However, as to the properties of the supporting core, it is only said that, apart from a high resistance to longitudinal insulation breakdown, it must have a high mechanical tensile strength. The assumption is that the glass-fibre rod is protected absolutely against external influences by the barriers or screens or the screen jacket surrounding it.

It has now been appreciated that the known composite insulators of this type do not possess the requisite electrical strength, especially as regards their long-term behavior, and this may be attributed especially to the fact that the sealing between the insulator core and the barriers or screens is not entirely satisfactory.

According to the present invention, therefore, a composite insulator comprises a rod with barriers or screens surrounding it and an intermediate layer between the rod and the barriers or screens; the rod is of a non-saponifiable resin reinforced with fibre-glass of low alkali content; the barriers or screens are of a moisture-repellent, non-saponifiable polymer containing a filler and the intermediate layer is of a moisture-repellent, non-saponifiable polymer.

The objects of the invention may be more fully understood from the following description and drawings in which FIG. 1 is a view partly broken away of one form which the novel insulator of the present invention may take.

Figure 1:
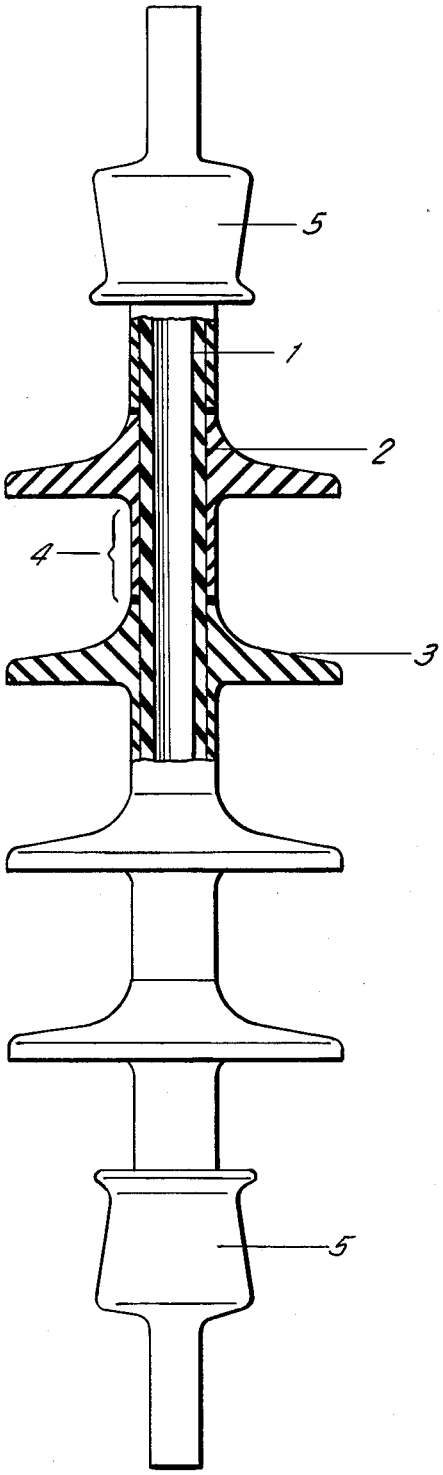
Figure 3:
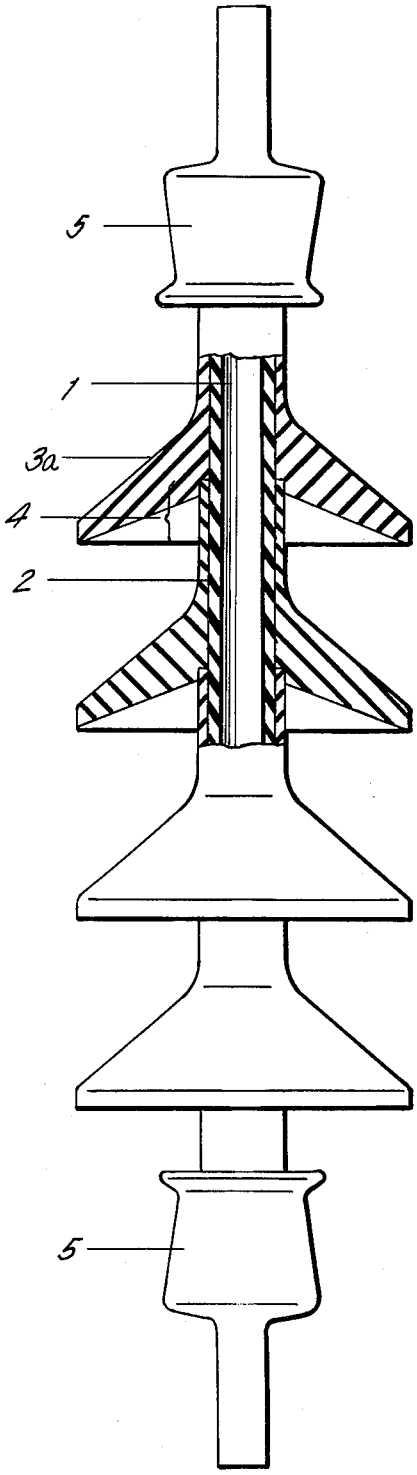
FIG. 3 is a view partly broken away of a modified form of the insulator of the present invention.

Referring first to FIG. 1, the insulator was produced by casting barriers or screens 3 on a vertically suspended rod 1 in such a way that the barriers or screens 3 overlapped. An intermediate layer 2 is provided for exclusion of deleterious materials as hereinafter described. In the structure of FIG. 3, the barriers or screens 3*a* have a somewhat different shape as hereinafter described. They are pushed onto rod 1 with the intermediate foreign-material-excluding layer 2 and overlap portion 4; and are provided with suspension fittings 5 for connection at one end to a support pylon and at the other end to the power line.

The structure of the insulators of the invention and the materials used are such that suitable properties are imparted to the individual functional zones of the insulator and that properties which are desirable in view of attack by water from the atmosphere are provided both by the material of the barriers or screens and by the material of the intermediate layer and the core.

The insulators are especially suitable for high-tension open-air use. They are adequate for a wide variety of electrical loads and requirements and have good water-resistance.

Also, in accordance with the invention, surface problems in connection with polymers and fillers can be eliminated. Moreover, the insulators are satisfactory even if they consist of individually prefabricated elements.

We have found that, surprisingly, polymers containing ether or acetal bonds are suitable for the barriers or screens, although it is known that such polymers have a high water absorptivity due to water deposition on these groups by virtue of hydrogen bridge formation. It is advantageous if the barriers or screens contain 20 to 70% by weight, preferably, 20 to 30% by weight, of a mineral filler which may be an alkali-free hydrated metal oxide, surface-treated with a non-or poly-functional silane, and if the glass transition temperature of the polymer of the barriers or screens is lower than −50° C. A silicone rubber or ethylene-propylene-rubber containing a filler such as aluminum hydroxide, surface-treated with a vinyl silane, has proved an especially favorable material for the barriers or screens. Also, an ethylene-propylene-rubber containing 50% by weight of an alkali-free titanium dioxide as filler has been found to be an advantageous material for the barriers or screens. The polymers for the barriers or screens should be stable to weather and ozone as well as being moisture-repellent and non-saponifiable. Furthermore, these polymers, on account of the necessary creepage current stability, must be free from aromatic substances and unsaturated hydrocarbon compounds. However, it is expedient in accordance with the invention if the resin for the rod is a cross-linkable polyaryl compound free of saponifiable moieties.

As resin for the rod, resins containing ether or acetal bonds may be used, especially epoxy resins in which the functional groups are held together through ether or acetal bonds and which have, in the cross-linked condition, a glass transition temperature of more than +100° C. It can be advantageous if, as binding resins for the glass-fibre reinforced rod, there are used epoxy resins of the diglycidyl ether type based on bisphenol A with suitable hardeners, preferably aromatic diamines, the resin, in the cross-linked condition, having a glass transition temperature or more than +100°. Moreover, an epoxy resin can be used, the epoxy groups of which in the final condition are bound to cyclo-aliphatic units which are held together through acetal bonds. As hardener, a dicarboxylic acid anhydride can be used. Aryl groups in the binding resin act in a generally favorable way upon the stability and especially they tend to result in glass transition temperatures above +100° C. and this is of value for ensuring good mechanical strength for the insulators even at high working temperatures. On the other hand, the glass transition temperature of the polymer of the barriers or screens is preferably below −50° C., as this assists proper functioning of the barriers of screens even at low working temperatures.

It is preferred that the alkali content of the fibre-glass of the rod is less than 0.8% wt.

The intermediate layer is preferably of a mono- or poly-functional polymer having a glass- transition temperature below −50° C. and this polymer is preferably a polyfunctional polyorganodimethylsiloxane. A linear polyorganodimethylsiloxane having a silanised dispersed silicic acid as filler has proved an especially expedient material for the intermediate layer. Depending on the temperature conditions likely to be encountered, it can be advantageous to use siloxanes with other non-saponifiable groups, for example polyorganomethylvinylsiloxanes, which are mono-functionally, difunctionally or poly-functionally cross-linked with one another.

The composite insulators in accordance with the invention have the advantage over the known composite insulators of synthetic plastics materials that a satisfactory seal of the barriers or screens from one another and of the end barriers or screens from suspension fittings is no longer necessary and account is taken of the water vapor permeability of the screen material. Thus, the problem of breakdown of the insulation in the longitudinal direction in the joint between the rod and the screens is satisfactorily solved. Furthermore, by use, in the polymers of the screens, of the preferred fillers, the insulators can be made highly resistant to films of foreign matter, especially in view of the moisture-repellence of the barrier or screen material. Also, the barrier or screen material has good creepage current resistance and is weather-resistant and ozone-resistant. By selection in accordance with the invention of the bonding resin in the glass-fibre reinforced rod, the insulator can tolerate high mechanical loads even at relatively high working temperatures.

In accordance with the invention, the composite insulator can be such that the barriers or screens are individually prefabricated and successively pushed onto the rod, overlapping one another. It can thus be ensured that even if there is thermal expansion, the glass-fibre reinforced rod, which itself is not resistant to creepage current and is not weather-resistant, is covered in every case by the creepage current-proof and weather-resistant barrier or screen material.

Furthermore, in accordance with the invention it can be advantageous if the barriers or screens are cast onto the rod using a mold which is slidably displaceable on the rod and forms a seal with the rod. In this case, the still liquid polymer for the next barrier or screen to be cast is pushed onto the previously cast and set barrier or screen, so that the still liquid polymer can harden onto the already set screen.

In the case of individually prefabricated and pushed-on barriers or screens, it is preferred that each barrier or screen has a tubular part and a part opening in trumpet form, the tubular part of each barrier or screen fitting into the trumpet-like, opened part of the preceding barrier or screen. As the intermediate layer is between the barriers or screens and the rod and as this layer, like the barriers or screens, is moisture-repellent and non-saponifiable and may be a mono- or poly-functional polymer that has a glass transition temperature lower than −50° C. and that is cross-linkable with the barrier or screens and with the rod, any water which reaches the surface of the rod, either through the points of the barriers or screens or by diffusion through the barrier or screen material is prevented from condensation and thus, in view of the water-repellence of the layer, a water film cannot form in the joint between the screens and the rod. Like the barrier or screen material, the intermediate layer is also unable to prevent diffusion of the water into the rod. This, however, is unimportant as, by virtue of the materials of which it is made, the glass-fibre reinforced rod is itself resistant to attack by water.

The intermediate layer desirably has a modulus of elasticity which is greater than the modulus of elasticity of the barrier or screen material and less than that of the rod. Furthermore, the layer can be highly cross-linkable and it can consist of weakly cross-linked or branched and cross-linked polyorganodimethylsiloxanes.

The insulators may be made by a method comprising inserting the rod, carrying the intermediate layer, into a two-part mold, pouring a liquid silicone polymer containing a filler into the mold and hardening the silicone polymer. This method yields an insulator in which the barriers or screens are an integral unit and in this specification, the term "screens " is to be regarded as broad enough to cover this case although in this case the barriers or screens are not clearly distinct from each other.

If the insulator is in the form of a long rod insulator, it is desirable that it should have a solid cross-section. On the other hand, if the insulator is to be used as an appliance insulator, or as a lead-in insulator it is desirable that it should possess a hollow cross-section.

As is apparent from the Examples hereafter, the selection, in accordance with the invention, of the materials for the composite insulator is of great importance. The method by which the insulator is formed is of lesser importance as the insulators may be made by various methods without much affecting their properties. Furthermore, it is apparent that sealing of the barrier or screen joints from one another is not essential for the proper functioning of the insulator. Thus, the insulator has the advantage that it can be produced in the cheapest and simplest manner without impairing its valuable properties. The barriers or screens and the glass-fibre reinforced rod may be prefabricated so that they can be kept in storage as semi-finished goods. Thus, if necessary, the insulators can be assembled easily from barriers or screens and rods according to the desired requirements.

The insulator can therefore be made very quickly. Moreover, specialist personnel are not required for the production of the insulator. In addition to these economic advantages, there is a further advantage in that the barriers or screens can be made from the polymer, e.g. elastomer, in accordance with the electrical requirements in question in a material-saving manner as compared with known production processes for composite insulators. The free choice regarding the method of making the insulator also readily permits designing the insulator individually as regards the number of barriers or screens per unit length, the barrier or screen diameter and as regards screen arrangements with different diameters. The expense of molding the barriers or screens may be very low, as very many such barriers or screens can be molded with one mold. Moreover, barriers or screens of one type may readily be produced alternately with barriers or screens of one or more other types and this flexibility can be economically advantageous.

This invention is further described with reference to the following Examples (some of which are comparative) in connection with the accompanying drawings.

EXAMPLE 1

Figure 2:
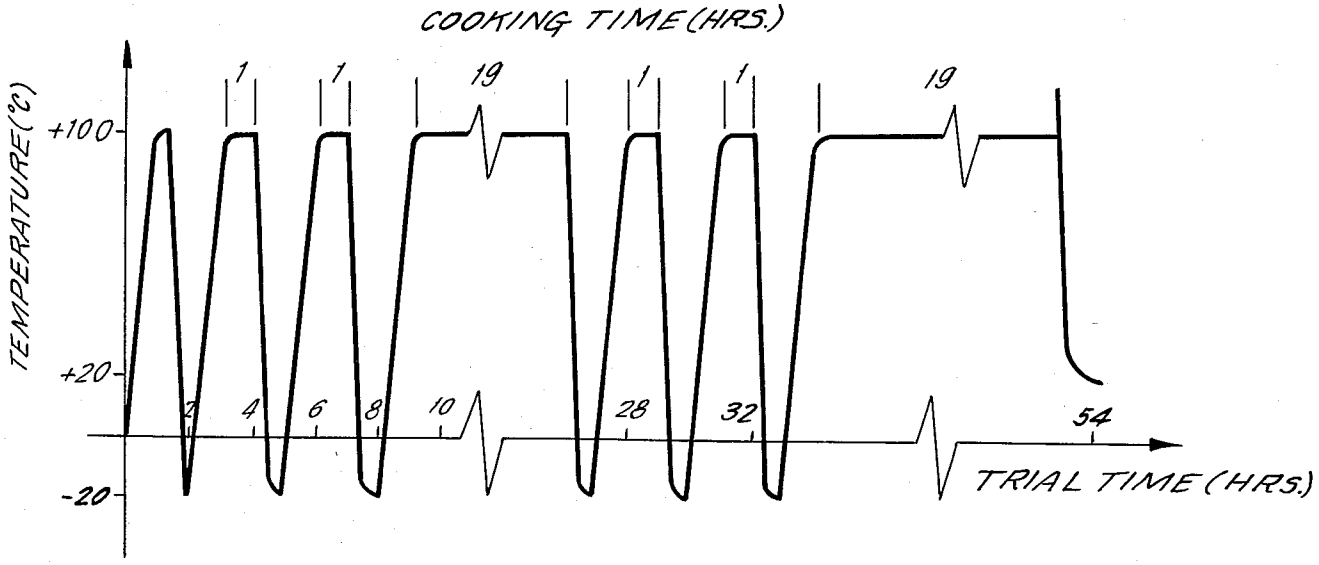
FIG. 2 is a chart showing the range of the combined boiling and temperature drop test to which the insulators were subjected to test their properties as hereinafter described.

The composite insulator as illustrated in FIG. 1 of the drawings was produced by casting barriers or screens 3, of a silicone elastomer, individually in succession by means of an upwardly open casting mold which was displaceable in a slidably sealing manner on vertically suspended rod 1 in such a way that the screens 3 overlapped. On rod 1, there was an intermediate layer 2 of a polyfunctional polyorganodimethylsiloxane. The rod 1 was produced from silanised fibre-glass having an alkali content of less than 0.8wt.%, and a bonding resin which consisted of a diglycidyl ether based on bisphenol A and an aromatic diamine as hardener. In FIG. 1, the overlap of the barriers or screens is indicated at 4, and suspension fittings 5, for example of metallic material, are provided at the ends of the insulator. The insulator was subjected to a combined boiling and temperature drop test, the cycles of which are represented in FIG. 2. After this experiment, the standing alternating voltage was ascertained according to VDE 0433, Sect. 13., and compared with the standing alternating voltage found before the experiment on the same insulator. The difference was within the range of the inherent experimental error of the test method. Then the insulator was charged with 50 surges of a flash surge voltage, which was 3 times greater than the standing surge voltage. No breakdown of insulation was detected. Accordingly, the insulator passed the test unaffected.

EXAMPLE 2 (comparative)

An insulator of similar construction to that of Example 1 was produced in the same manner except that the bonding resin of the rod was a cycloaliphatic diglycidyl ester based on hexahydrophthalic acid and cycloaliphatic dicarboxylic acid anhydride as hardener. The insulator was subjected to the same test cycle as in Example 1. In ascertaining the standing alternating voltage, it was found that the insulation in the joint between the rod and the screens was overcome at a value 30% below the standing alternating voltage ascertained before the temperature cycle experiment.

EXAMPLE 3 (comparative)

An insulator similar to that of Example 1 was produced in the same way except that the intermediate layer was omitted. After the boiling temperature drop experiment, the insulation broke down at the joint between the screens and the rod in the ascertaining of the standing alternating voltage.

EXAMPLE 4 (comparative)

An insulator of similar construction to that of Example 1 was produced in the same manner except that the barriers or screens were produced from an elastomer consisting of a diisocyanate cross-linked with a branched polyester polyhydric alcohol and filled with untreated quartz flour. The production of the screens was catalysed by dibutyltindilaurate. After the boiling temperature drop experiment, the insulation broke down in the joint between screens and the rod.

EXAMPLE 5 (comparative)

An insulator of similar construction to that of Example 1 was produced in the same way except that the bonding resin of the rod was an unsaturated polyester resin derived from an unsaturated dicarboxylic acid and aliphatic polyhydric alcohols, dissolved in monostyrene. In the ascertaining of the standing alternating voltage according to the boiling temperature drop test, the insulation broke down in the joint between the rod and the silicone screens surrounding it.

EXAMPLE 6

A composite insulator was produced by pushing individually prefabricated screens of a silicone elastomer onto a glass-fibre reinforced rod according to Example 1, the bore diameter of the screens being smaller than the rod diameter. The filler of the screen material consisted of a surface-silanised aluminium hydroxide, the intermediate layer consisted of a linear polyorganodimethylsiloxane and a silanised dispersed silicic acid. In FIG. 3, the rod is designated by 1, the intermediate layer by 2, the barriers or screens by 3*a*, the overlaps of the screens by 4 and the suspension fitting on the ends of the insulator by 5.

As described in Example 1, the insulator was subjected to a combined boiling temperature drop test. The subsequently determined values of the standing alternating voltage and the flash surge voltage showed that the insulator had withstood the test unaffected.

EXAMPLE 7

An insulator generally like that of Example 6 was produced in a generally similar manner. However, in the present Example, the barriers or screens consisted of an ethylenepropylene rubber containing, as filler, an alkali-free titanium dioxide in an amount of 50% by weight. Moreover, in this case the screens were produced with a bore diameter which corresponded to the diameter of the rod. Also, the screens were so formed that they did not overlap. The electrical measurements after the execution of the boiling temperature drop experiment according to Example 1 showed that the insulator had withstood the boiling temperature drop test unaffected.

EXAMPLE 8 (comparative)

An insulator was produced in a manner generally similar to that of Example 6. However, in the present Example, as in Example 2, the bonding resin of the rod was based on a diglycidyl ester of hexahydrophthalic acid and hexahydrophthalic acid anhydride as hardener. After the boiling temperature drop test, the insulation failed along the joint between the screens and the rod in the subsequent ascertaining of the standing alternating voltage.

EXAMPLE 9 (comparative)

An insulator generally like that of Example 6 was produced in a generally similar manner. However, in the present Example, the intermediate layer was omitted. Before the boiling temperature drop test, the insulator was subjected to the standing alternating voltage test and the flash surge voltage test, as described in Example 1. The insulation failed in the joint between the screens and the rod in the flash surge voltage test.

EXAMPLE 10

A composite insulator in which the screens form an integral unit was produced by use of a two-part mold of suitable metals or synthetic plastics materials. The mold shape was a negative reproduction of the shape of the finished composite insulator and the mold was used to mold the screens around a rod formed of a vinyl-siloxane-treated fibre-glass with an alkali content of less than 0.8% wt. and a bonding resin consisting of a cycloaliphatic 1,2 epoxy resin, having acetal bonds, and, as hardener, a cycloaliphatic dicarboxylic acid anhydride. The rod itself was pre-treated with an intermediate layer of a polyfunctional polyorganodimethylsiloxane containing a silanised highly dispersed silicic acid as filler. A liquid silicone polymer filled with aluminium hydroxide was poured into the mold by means of a pressure-gelling process, injection-molding, etc. and caused to harden by means of a suitable cross-linking agent. After manufacture, the insulator was subjected to the test as described in Example 6 and no damage to the insulator could be detected.

What I claim is:

1. A composite insulator, comprising a rod with screens surrounding it and an intermediate layer between the rod and the screens in which the rod comprises a non-saponifiable resin reinforced with glass fibers of low alkali content, the screens being of a moisture-repellent, non-saponifiable polymer containing a filler and the intermediate layer being of a moisture-repellent, non-saponifiable polymer.

2. The insulator of claim 1 in which the screens contain, as filler, 20 to 70% by weight of an alkali-free, hydrated metal oxide surface-treated with a silane.

3. The insulator of claim 2 in which the filler is present in an amount of about 20 to 30% by weight.

4. The insulator of claim 2 in which the polymer of the screens and of the intermediate layer have glass transition temperatures below −50° C. and in which the resin on said rod has a glass transition temperature of more than 100° C.

5. The insulator of claim 4 in which said resin is a bisphenol A epoxy resin containing an aromatic diamine as hardener and said glass fibers have an alkali content of less than 0.8%, the resin of said screens is a silicone rubber, said filler is aluminum hydroxide surface treated with a vinyl silane and said intermediate layer comprises a polyorganodimethyl siloxane containing a silanized dispersed silicic acid as filler.

6. The insulator of claim 4 in which said resin is a cycloaliphatic epoxy resin containing acetal bonds and a dicarboxylic anhydride as hardener, said polymer of said screens is an ethylene-propylene rubber containing aluminum hydroxide surface treated with a vinyl silane, and said intermediate layer is of an un-crossed link polyorganodimethyl siloxane containing a silanized dispersed silicic acid as filler.

7. The insulator of claim 4 in which the alkali contents of the glass fiber is less than 0.8% by weight and in which the intermediate layer has a modulus of elasticity which is greater than that of the screens and less than that of the rod.

8. The insulator of claim 1 in which the resin of the rod contains ether bonds.

9. The insulator of claim 1 in which the resin of the rod is a cross-linked polyaryl compound free of saponifiable moieties.

10. The insulator of claim 1 in which the alkali content of the glass fiber is less than 0.8% wt.

11. The insulator according of claim 1 in which the intermediate layer comprises a polyorganodimethyl siloxane.

12. The insulator of claim 11 in which the intermediate layer comprises a linear polyorganodimethyl siloxane containing a silanized dispersed silicic acid as filler.

13. The insulator of claim 1 in which the intermediate layer has a modulus of elasticity which is greater than that of the screens and less than that of the rod.

14. The insulator of claim 1 in which the intermediate layer is highly cross-linked.

15. The insulator of claim 1 in which the intermediate layer is weakly cross-linked.

16. The insulator of claim 1 in which the screens are individual structures successively mounted on said rod and push fit on said rod.

17. The insulator of claim 1 in which the screens are cast onto said rod forming a seal therewith.

18. The insulator of claim 1 in which each of the screens has a tubular part and a part opening in trumpet from, the tubular part of each screen fitting into the trumpet-like opened part of the preceding screen.

19. The insulator of claim 1 in which the resin of the rod contains acetal bonds.

* * * * *